US011578906B2

(12) United States Patent
Ansted et al.

(10) Patent No.: US 11,578,906 B2
(45) Date of Patent: Feb. 14, 2023

(54) THERMALLY INSULATED PACKAGING FOR SHIPPING LIQUID IN BOTTLES

(71) Applicant: Viking Cold Solutions, Inc., Houston, TX (US)

(72) Inventors: Roger Ansted, Houston, TX (US); Stan Nabozny, Houston, TX (US)

(73) Assignee: VIKING COLD SOLUTIONS, INC., Houston, TX (US)

( * ) Notice: Subject to any disclaimer, the term of this patent is extended or adjusted under 35 U.S.C. 154(b) by 106 days.

(21) Appl. No.: 17/153,796

(22) Filed: Jan. 20, 2021

(65) Prior Publication Data

US 2021/0140697 A1 May 13, 2021

Related U.S. Application Data

(63) Continuation of application No. 15/921,438, filed on Mar. 14, 2018, now Pat. No. 10,928,115, which is a continuation of application No. PCT/US2016/051656, filed on Sep. 14, 2016.

(60) Provisional application No. 62/218,414, filed on Sep. 4, 2015.

(51) Int. Cl.

| | |
|---|---|
| ***G01K 13/00*** | (2021.01) |
| ***F25D 3/08*** | (2006.01) |
| ***F25D 29/00*** | (2006.01) |

(52) U.S. Cl.

CPC ..... *F25D 3/08* (2013.01); *F25D 29/003* (2013.01); *F25D 2201/14* (2013.01); *F25D 2303/082* (2013.01); *F25D 2303/08222* (2013.01); *F25D 2331/803* (2013.01); *F25D 2331/804* (2013.01); *F25D 2331/805* (2013.01); *F25D 2331/809* (2013.01); *F25D 2700/16* (2013.01)

(58) Field of Classification Search

CPC ..... F25D 3/08; F25D 29/003; F25D 2201/14; F25D 2303/082; F25D 2303/084; F25D 2303/085; F25D 2303/08222; F25D 2331/803; F25D 2331/805; F25D 2331/804; F25D 2331/809; F25D 2700/16

USPC ..... 62/129

See application file for complete search history.

(56) References Cited

U.S. PATENT DOCUMENTS

| | | | | |
|---|---|---|---|---|
| 4,003,728 | A | 1/1977 | Rath | |
| 5,878,593 | A | 3/1999 | Lane et al. | |
| 6,065,303 | A * | 5/2000 | Harris | F25D 31/007 62/457.4 |

(Continued)

FOREIGN PATENT DOCUMENTS

| | | | |
|---|---|---|---|
| JP | 2010276310 | A | 12/2010 |

OTHER PUBLICATIONS

International Search Report issued in corresponding International Application No. PCT/US2016/051656 dated Nov. 18, 2016 (5 pages).

(Continued)

*Primary Examiner* — Henry T Crenshaw
*Assistant Examiner* — Kamran Tavakoldavani
(74) *Attorney, Agent, or Firm* — Duane Morris LLP; Philip Woo

(57) ABSTRACT

A thermally insulated structure for shipping goods, the structure including an insulated box having a goods receptacle and a phase change material module receptacle. The structure further including a phase change material module, and a set of vacuum panels configured to form an encapsulating layer around the insulated box.

24 Claims, 7 Drawing Sheets

(56) References Cited

U.S. PATENT DOCUMENTS

| | | | |
|---|---|---|---|
| 7,516,600 | B1 | 4/2009 | Flora |
| 8,443,623 | B2 | 5/2013 | Matta et al. |
| 8,938,986 | B2 | 1/2015 | Matta et al. |
| 2011/0290792 | A1 | 12/2011 | Krzak et al. |
| 2014/0026595 | A1 | 1/2014 | Pause |
| 2015/0166244 | A1 | 6/2015 | Wood et al. |

OTHER PUBLICATIONS

Written Opinion issued in corresponding International Application No. PCT/US2016/051656 dated Nov. 18, 2016 (6 pages).

* cited by examiner

THERMALLY INSULATED PACKAGING FOR SHIPPING LIQUID IN BOTTLES

CROSS REFERENCE TO RELATED APPLICATIONS

This application is a continuation of U.S. application Ser. No. 15/921,438 filed on Mar. 14, 2018, which is a continuation of International PCT Application No. PCT/US2016/051656 filed on Sep. 14, 2016, which claims the benefit of U.S. Provisional Patent Application 62/218,414 filed on Sep. 14, 2015 each of which are incorporated here in its entirety of the invention by way of example and are not meant to limit the scope of the claims.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid obscuring the description.

In general, embodiments of the invention relate to packaging of goods for shipping. The packaging may be a thermally insulated structure. The thermally insulated structure may regulate a temperature of a good, disposed within the packaging, during shipping.

In one or more embodiments of the invention, the thermally insulated structure may include an exterior insulating layer that encapsulates the goods and one or more phase change material modules. The exterior insulating layer may reduce the flow of heat, to or from, the goods and the phase change material modules from the environment surrounding the thermally insulated structure. The phase change material modules may act as a heat sink that absorbs or releases heat that flows to or from the environment surrounding the thermally insulated structure and thereby reduces the impact of heat flow on the temperature on the goods.

In one or more embodiments of the invention, the thermally insulated structure may include a temperature data tracker. The temperature data tracker may be disposed proximate to the goods. The temperature tracker may record temperature readings during shipment of the goods. The recorded temperature readings may enable a receiver of the shipment to determine a temperature profile to which the goods were exposed during shipment. The temperature profile may indicate a quality change of the goods during the shipment.

Additional embodiments of the invention may relate to a method of assembling a shipping box. The method may include selecting and/or configuring a thermally insulated structure. The thermally insulated structure may be selected and/or configured based on, at least in part, a set of shipment parameters. The shipment parameters may include a shipping route, a type of goods to be shipped, a time of year/season of the shipment, and/or a desired temperature profile during the shipment.

Figure 1:
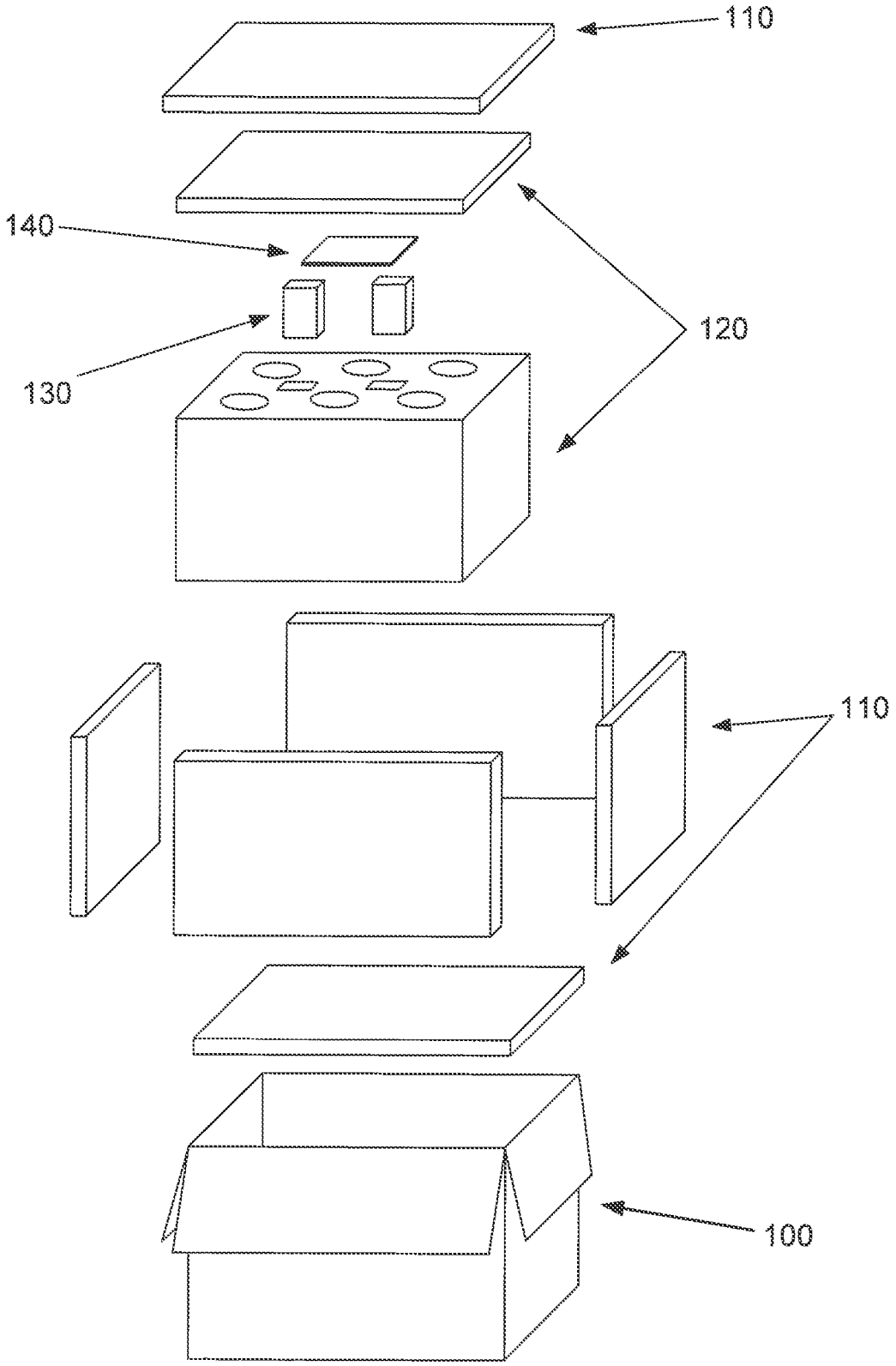
FIG. 1 shows a diagram of thermally insulated structure in accordance with one or more embodiments of the invention.

FIG. 1 shows an exploded diagram of a thermally insulated structure in accordance with one or more embodiments of the invention. The thermally insulated structure may include an outer shell (100), one or more vacuum panels (110), an insulated box (120), one or more phase change material modules (130), and a temperature data tracker (140). Each of the components of the thermally insulated structure is described below.

In one or more embodiments of the invention, the outer shell (100) may be a plastic box. The outer shell (100) may include an opening by which other structures may be placed and thereby disposed within the outer shell (100). The outer shell (100) may be formed of a plastic material such as, for example, polypropylene, high density polyethylene, or polyethylene terephthalate. The plastic material may be corrugated or otherwise structured to improve the strength of the outer shell (100). The outer shell (100) may have a thickness of between 5-12 mm. The outer shell (100) may include one or more flaps that may be actuated to open and/or close the opening of the outer shell (100).

In one or more embodiments of the invention, the vacuum panels (110) may be removable panels that resist the flow of heat through the panels. The panels (110) may be configured to form an encapsulating layer when placed within the outer shell (100). By forming an encapsulating layer, the flow of heat to or from an exterior environment surrounding the thermally insulated structure to or from the goods or other structures within the encapsulating layer may be reduced. There may be, for example, six panels including a top panel, bottom panel, and four side panels. There may be other numbers, shapes, and configurations of the panels without departing from the invention.

Figure 2:
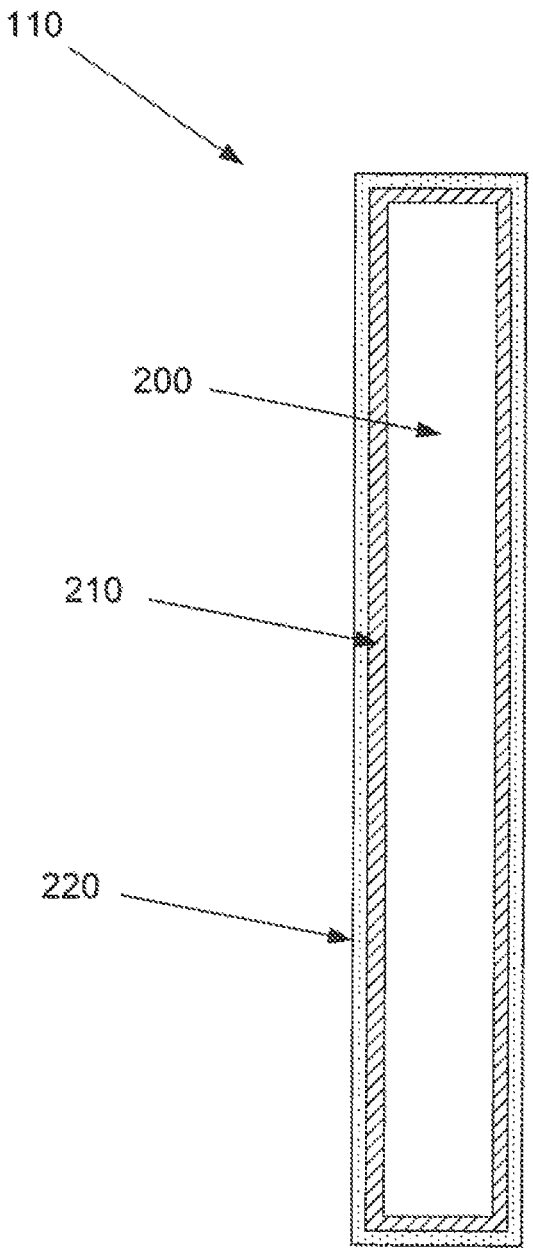
FIG. 2 shows a diagram of vacuum panel in accordance with one or more embodiments of the invention.

Each vacuum panel of the vacuum panels (110) may have a structure as shown in FIG. 2. Each panel may have a thickness of between 0.5 and 1.5 inches. The thickness may be set based on a desired insulation rating of the panel, e.g., R22-R40. Each panel may include a core (200), an inner layer (210) that encapsulates the core (200), and an outer layer (220) that encapsulates the inner layer (210). Each of the components of the panels are described below.

In one embodiment of the invention, the core (200) may be a plastic barrier encasing an insulating foam. The plastic barrier material may be biaxially-oriented polyethylene terephthalate including a metalized aluminum finish. The plastic barrier encasing an insulating foam may be a thermal insulator that resists the flow of heat.

In one embodiment of the invention, the core (200) may be a glass panel. The glass panel may be semi-ridged or otherwise structures and formed of, for example, silica, aerogel, or nano-porous silica. The glass panel may be a thermal insulator that resists the flow of heat.

The inner layer (210) may be a moisture barrier that prevents the flow of moisture. The inner layer (210) may be, for example, a plastic film. The plastic film may be biaxially-oriented polyethylene terephthalate, polyvinyl chloride, or polyethylene and may include a metalized aluminum finish. When the vacuum panels are arranged in the thermally insulated structure, the inner layer (210) of each panel may form a second encapsulating layer that prevents the flow of moisture to or from the goods or other structures within the thermally insulated structure.

The exterior layer (220) may be a radiant barrier that prevents the transmission of heat through radiation. The inner layer (210) may be, for example, a biaxially-oriented polyethylene terephthalate film. The biaxially-oriented polyethylene terephthalate film may include one or more metallization layers that absorbs and/or reflects electromagnetic radiation. When vacuum panels are arranged in the thermally insulated structure, the exterior layer (220) of each panel may form a third encapsulating layer that prevents the flow of electromagnetic radiation to or from the goods or other structures within the thermally insulated structure and thereby prevents heating or cooling of the goods or other structures by electromagnetic radiation. In one or more embodiments of the invention, the electromagnetic radiation may be infrared radiation.

Returning to FIG. 1, the insulated box (120) may be a thermally insulated box. The thermally insulated box may be, for example, a foam box. The foam may be, for example, a high grade expanded polystyrene control foam box. The insulated box may have a shape that fills any space within the thermally insulated box that is not occupied by goods or other structures. In other words, the insulated box (120) has a shape set to fill any space within the thermally insulated structure that would otherwise be occupied by air.

In one or more embodiments of the invention, there may be gaps between the insulated box (120) and one or more of the vacuum panels without departing from the invention. In one or more embodiments of the invention, the insulated box (120) may not fill all of space not occupied by other structures of the thermally insulated structure without departing from the invention.

Figure 3A:
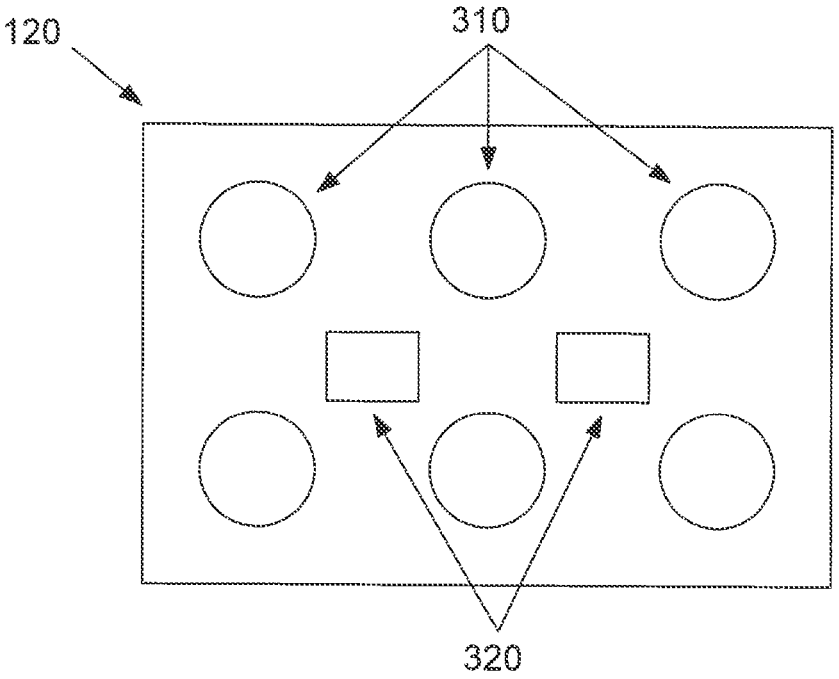
FIG. 3A shows a top view diagram of an insulated box in accordance with one or more embodiments of the invention.

FIG. 3A shows a top view of the insulated box (120) in accordance with one or more embodiments of the invention. The insulated box may include one or more goods receptacles (310) and one or more phase change material module receptacles (320). In one or more embodiments of the invention, there may be between 1 and 18 goods receptacles (310) and between 1 and 18 phase change material module receptacles (320). The insulated box may include other numbers of goods receptacles (310) without departing from the invention.

The goods receptacles (310) may be depressions, indentations, or recesses in the insulated box (120). The shape of the goods receptacles (310) may correspond to a shape of a good to be received by the goods receptacles (310). For example, the goods receptacles (310) may be cylindrical recesses corresponding to the shape of a liquid container. The liquid container may be, for example, a bottle of wine. A user of the thermally insulated structure may place goods in corresponding goods receptacles (310). The goods may be, for example, liquids such as wine, beer, or liquor; dairy products such as yogurt, cheese, or butter; pharmaceutical products such as injectable drugs, compounded drugs, drugs in pill form, bacterial samples, viral samples, tissue samples, or transplant materials; or any other good for which a temperature profile may be maintained during shipping.

The phase change material module receptacles (320) may be depressions, indentations, or recesses in the insulated box (120). The shape of each of the phase change material module receptacles (320) may correspond to a shape of a phase change material module (130). For example, the phase change material module receptacles (320) may be rectangular recesses corresponding to the shape of a rectangular and/or panel shaped phase change material module. A user of the thermally insulated structure may place a phase change material module, heated or cooled to a predetermined temperature, into a corresponding phase change material module receptacle (320).

Figure 3B:
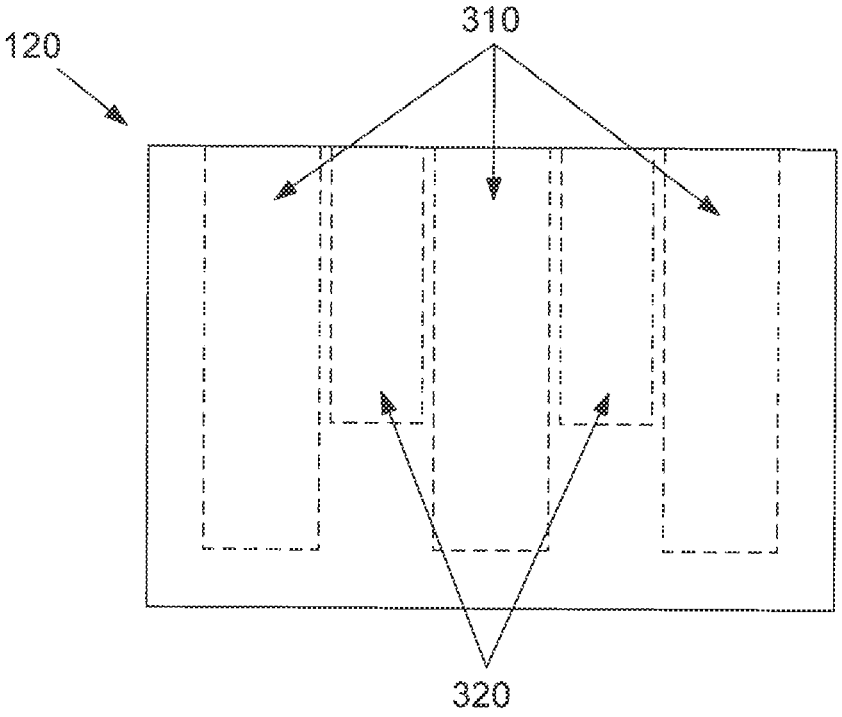
FIG. 3B shows a side view diagram of an insulated box in accordance with one or more embodiments of the invention.

FIG. 3B shows a side view of the insulated box (120) in accordance with one or more embodiments of the invention. As seen from FIG. 3B, the goods receptacles (310) may extend into the insulated box (120) and thereby form cavities for receiving a good. Similarly, the phase change material module receptacles (320) may extend into the insulated box (120) and thereby form other cavities for receiving phase change material modules (130).

While examples of the quantity, shape, and location of the goods receptacles (310) and phase change material module receptacles (320) are shown in FIGS. 3A and 3B, numerous variation are possible without departing from the invention.

Figure 4A:
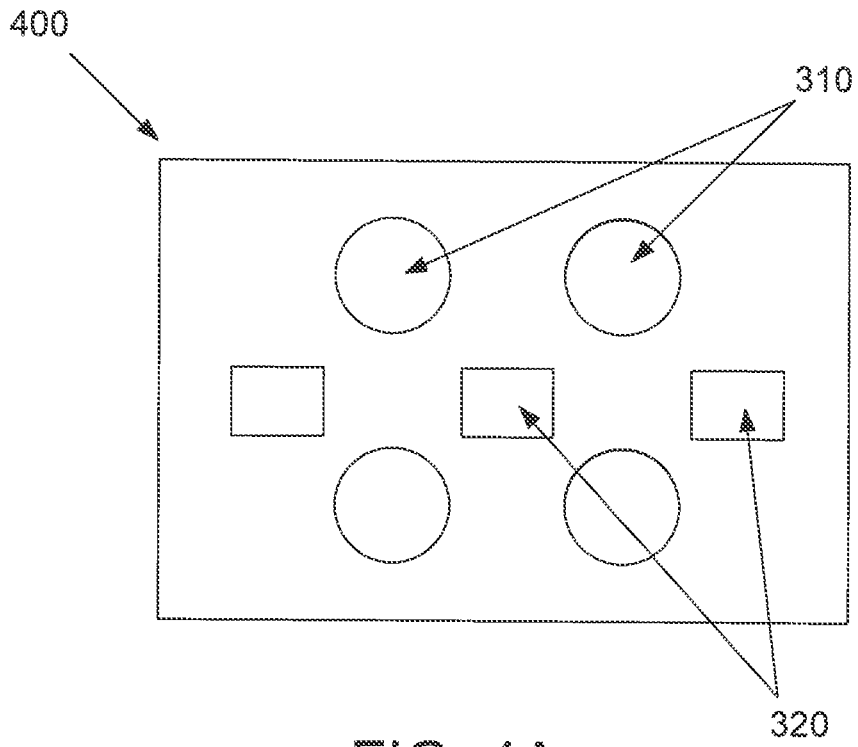
FIG. 4A shows a top view diagram of an insulated box in accordance with one or more embodiments of the invention.
Figure 4B:
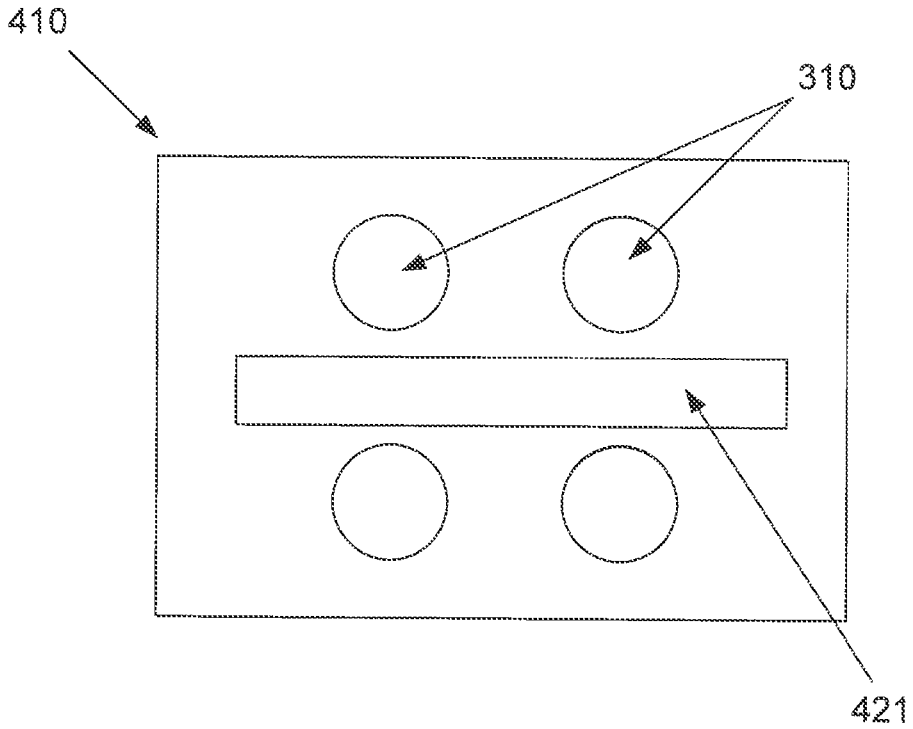
FIG. 4B shows a top view diagram of an insulated box in accordance with one or more embodiments of the invention.
Figure 4C:
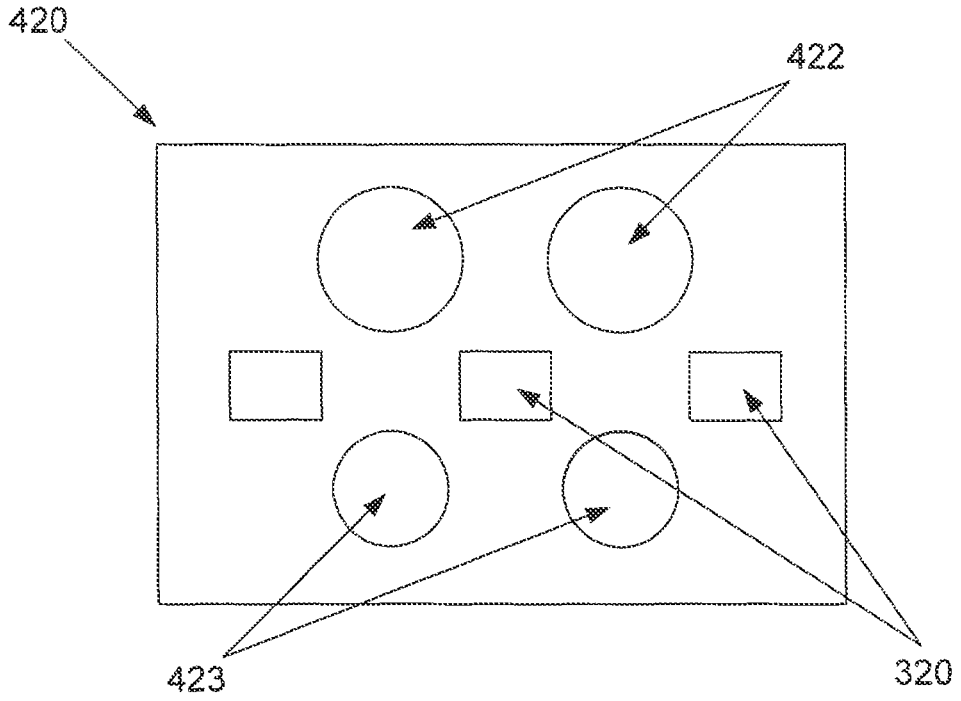
FIG. 4C shows a top view diagram of an insulated box in accordance with one or more embodiments of the invention.
Figure 4D:
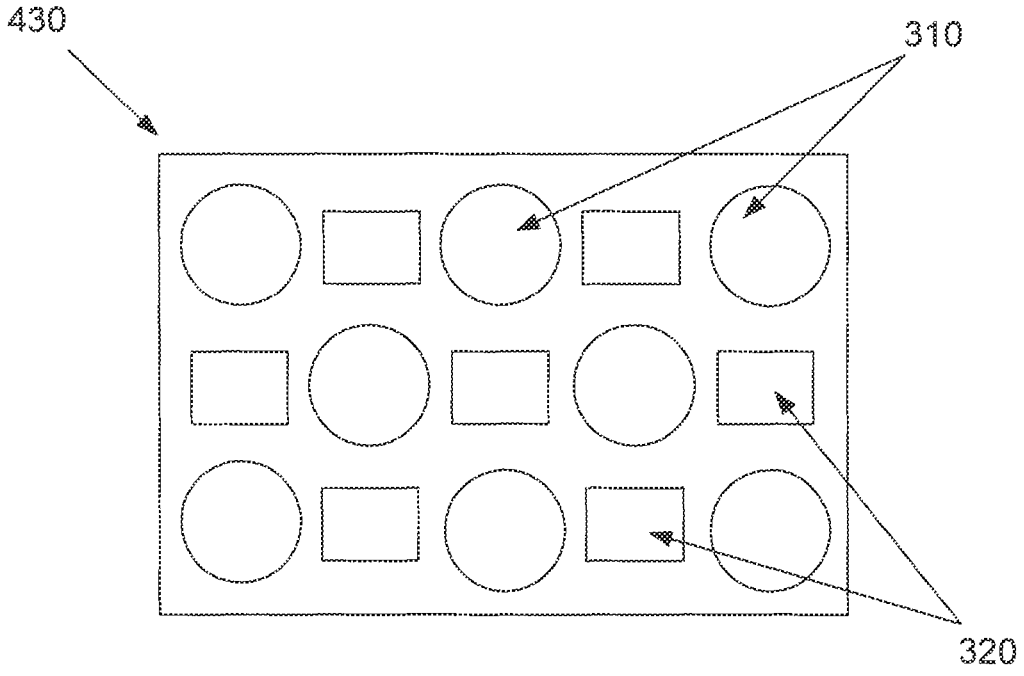
FIG. 4D shows a top view diagram of an insulated box in accordance with one or more embodiments of the invention.
Figure 5A:
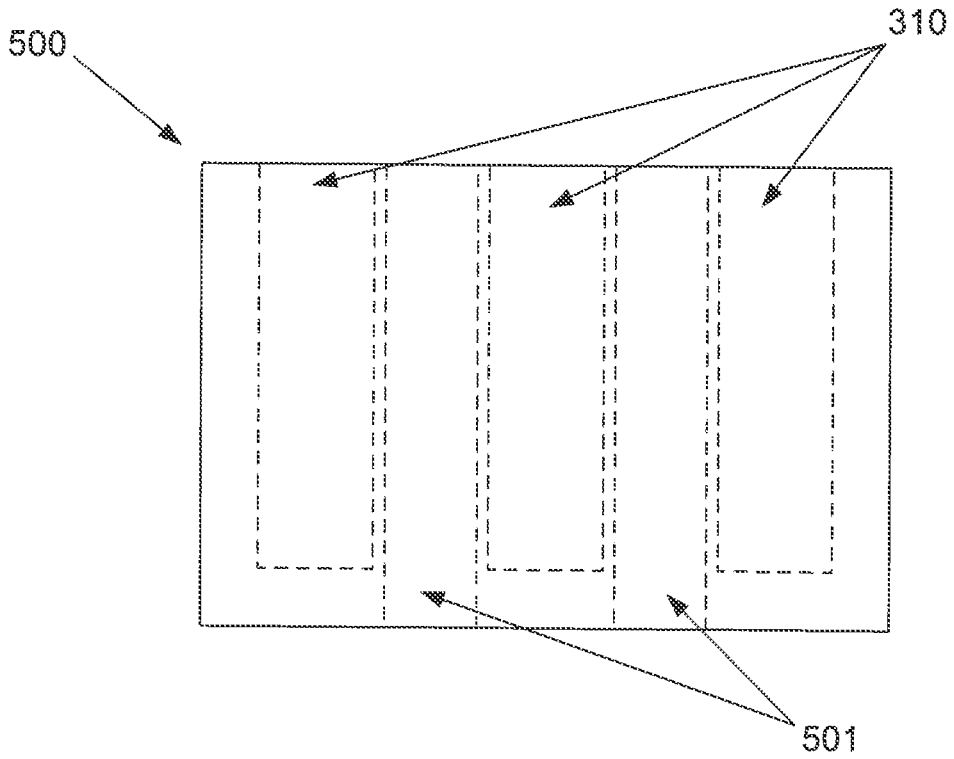
FIG. 5A shows a side view diagram of an insulated box in accordance with one or more embodiments of the invention.
Figure 5B:
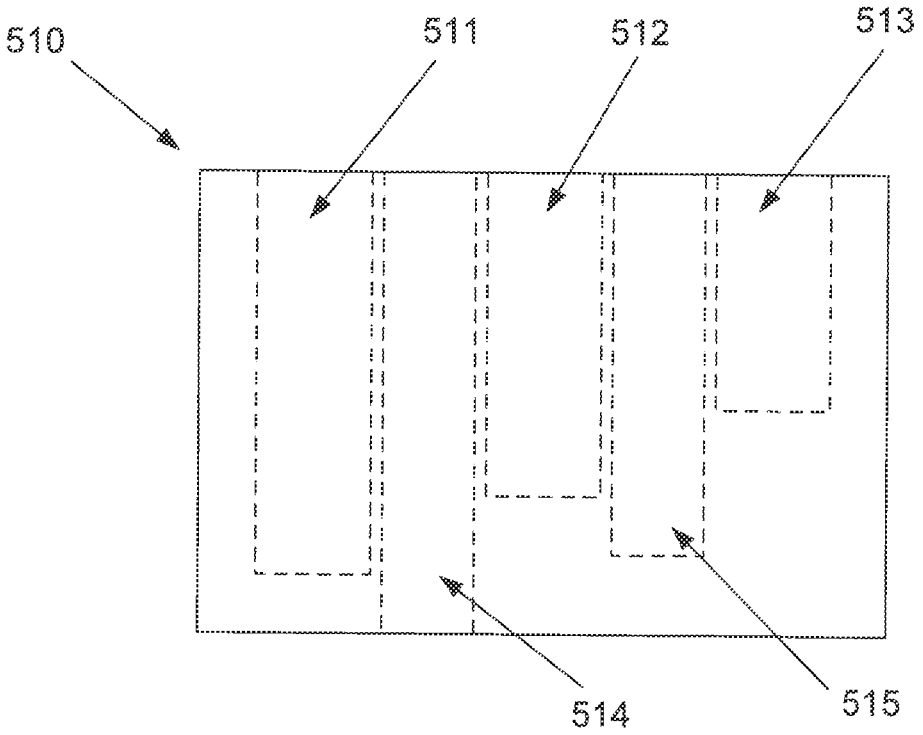
FIG. 5B shows a side view diagram of an insulated box in accordance with one or more embodiments of the invention.

FIGS. 4A-4D show examples of top views of variations of the insulated box (120) and FIGS. 5A and 5B show examples of side views of variations of the insulated box (120) in accordance with one or more embodiments of the invention.

In FIG. 4A, the insulated box (400) in accordance with embodiments of the invention includes four goods receptacles (310) and three phase change material module receptacles (320). The phase change material module receptacles (320) may be disposed between the goods receptacles (310).

In FIG. 4B, the insulated box (410) in accordance with embodiments of the invention includes four goods receptacles (310) and one large phase change material module receptacle (421). The large phase change material module receptacle (421) may be disposed between the goods receptacles (310) and may be larger than the phase change material module receptacles (320) shown in FIG. 4A.

In FIG. 4C, the insulated box (420) in accordance with embodiments of the invention includes two large goods receptacles (422), two small goods receptacles (423), and three phase change material module receptacles (320). The phase change material module receptacles (320) may be disposed between the two large goods receptacles (422) and two small goods receptacles (423).

In FIG. 4D, the insulated box (430) in accordance with embodiments of the invention includes eight goods receptacles (310) interspersed with seven phase change material module receptacles (320). The insulated box (430) in FIG. 4D may be a configurable box, e.g., configurable by a user, and include pieces of insulating material (not shown) corresponding to teach of the eight goods receptacles (310) and seven phase change material module receptacles (320). Thus, a user may configure the insulated box (430), based on a number of goods and/or number of phase change material modules, by placing one or more pieces of insulating material in one or more of the eight goods receptacles (310) and seven phase change material module receptacles (320).

Now turning to the cross sectional diagrams, in FIG. 5A the insulated box (500) in accordance with embodiments of the invention includes goods receptacles (310) that extend, partially, through a thickness of the insulated box (500). The insulated box (500) also includes phase change material module receptacles (501) that extend through the thickness of the insulated box (500).

In FIG. 5B, the insulated box (510) in accordance with embodiments of the invention includes a first goods receptacle (511) that extends, partially, through the thickness of the insulated box (500) to a first depth, a second goods receptacle (512) that extends, partially, through the thickness of the insulated box (500) to a second depth, and a third goods receptacle (513) that extends, partially, through the thickness of the insulated box (500) to a third depth. Each of the first, second, and third depths may be different depths. Each of the depths may be between zero and the thickness insulated box (510). The insulated box (510) also includes phase change material module receptacles (514) that extend through the thickness of the insulated box (510), and phase change material module receptacles (515) that extend partially through the thickness of the insulated box (510).

While embodiments of the insulated box (400, 410, 420, 430, 500, 510) are shown in separate diagrams of FIGS. 4A-5B, embodiments of the invention include any number and combination of features shown.

Returning to FIG. 1, each of the phase change material modules (130) may include a plastic bottle. The plastic bottle may be made of, for example, high density polyethylene plastic. The shape of the plastic bottle may be, for example, cylindrical, rectangular, or in the form of a panel. The plastic bottle may have other shapes without departing from the invention. The plastic bottle may include up to 1.5 kilograms of a phase change material. The phase change material may include a solid-liquid phase temperature set based on a desired temperature profile of a shipment. The quantity and/or type of phase change material may be set based on a desired temperature at which the goods included in the thermally insulated structure are to be maintained. In one or more embodiments of the invention, the phase change material may be water include a quantity of one or more salts. The quantity of one or more salts may be set, at least in part, on the quantity of water and a desired temperature profile of the shipment.

In one or more embodiments of the invention, the desired temperature profile may be having a maximum temperature during a shipment. Based on the maximum temperature during the shipment, the quantity of water and quantity of salt may be set to cause a solution of the quantity of water and the quantity of salt to have a solid-liquid phase change transition temperature at or below the maximum temperature during the shipment.

In one or more embodiments of the invention, the desired temperature profile may be having a minimum temperature during a shipment. Based on the minimum temperature during the shipment, the quantity of water and quantity of salt may be set to cause a solution of the quantity of water and the quantity of salt to have a liquid-solid phase change transition temperature at or above the minimum temperature during the shipment.

One or more of the phase change material modules (130) may include a liner disposed on an exterior of the bottle. The liner may be plastic or rubber. The liner may regulate heat transfer between the phase change material and the insulated box (120) and thereby ensure regulation of the temperature of a good disposed in the insulated box (120).

The temperature data tracker (140) may be configured to periodically measure a temperature by a temperature sensor during a shipment of the thermally insulated structure. The temperature may be a temperature of the goods and/or other structures of the thermally insulated structure.

The data tracker (140) may be configured to send the measured data to a shipper or receiver of the package by a wireless link during the shipment, e.g., periodically, or after completing of the shipment, e.g., in a single message. The wireless link may be direct or indirect, e.g., by a relay such as a cellular network. To support communications by the wireless link, the temperature data tracker (140) may include a transmitter that broadcasts temperature measurements to a receiver during shipment of the thermally insulated structure. A user, e.g., sender or receiver of shipment, may have access to the receiver and thereby be notified of temperatures of the goods included in the thermally insulated structure during shipment.

The temperature data tracker (140) may be configured to store the temperature measurements. In one or more embodiments of the invention, the temperature data tracker (140) may include a memory, volatile and/or persistent, that records the temperature measurements during shipment. The temperature data tracker (140) may include an interface, for example, a universal serial bus interface, that transmits the temperature measurements stored in the memory of the temperature data tracker (140) when prompted by a user and thereby notifies the user of the temperatures of the goods included in the thermally insulated structure during shipment.

In one or more embodiments of the invention, the temperature data tracker (140) may including, at least, a number of temperature sensors corresponding to the number of goods housed in the thermally insulated structure. Each temperature sensor may be disposed on a separate good and thereby enable the temperature data tracker (140) to measure and/or store the measured temperature of each good disposed within the thermally insulated structure.

When a thermally insulated structure is shipped, a shipper, receiver, or a third party may be provided with an access code. The access code may enable the shipper, receiver, or third party to receive the temperatures measured by the temperature data tracker (140) during a shipment.

The access code may, for example, be used with an application executing on a mobile phone. The application may communicate with a server storing the temperature measurements and thereby enable the shipper, receiver, or third party to access the temperature measurements.

The access code may, for example, be used with a website. The website may communicate with a server storing the temperature measurements and thereby enable the shipper, receiver, or third party to access the temperature measurements.

Thus, the temperature data tracker (140) may enable the shipper, receiver, or a third party to receive temperature data regarding a shipment periodically during the shipment or after completion of the shipment.

A thermally insulated structure in accordance with one or more embodiments of the invention may be used to ship goods, e.g., used as a shipping box. Components of a thermally insulated structure used as a shipping box may vary depending on a set of shipping parameters of the shipment. The shipping parameters may include a shipping route, a type of goods to be shipped, a time of year/season of the shipment, a duration of the shipment, and/or a desired temperature profile during the shipment.

In one or more embodiments of the invention, there may be a number of thermally insulated structures having different components. Each of the thermally insulated structures may be configured to meet a certain range of shipping parameters, e.g., a first thermally insulated structure may be configured to maintain a temperature of a shipment for 3 day, a second thermally insulated structure may be configured to maintain a temperature of a shipment for 4 days, etc. Further, each of the thermally insulated structures may be further configurable by inserting one or more filler components into one or more of the goods receptacles and/or phase change material module receptacles of an insulated box of a thermally insulated structure.

Figure 6:
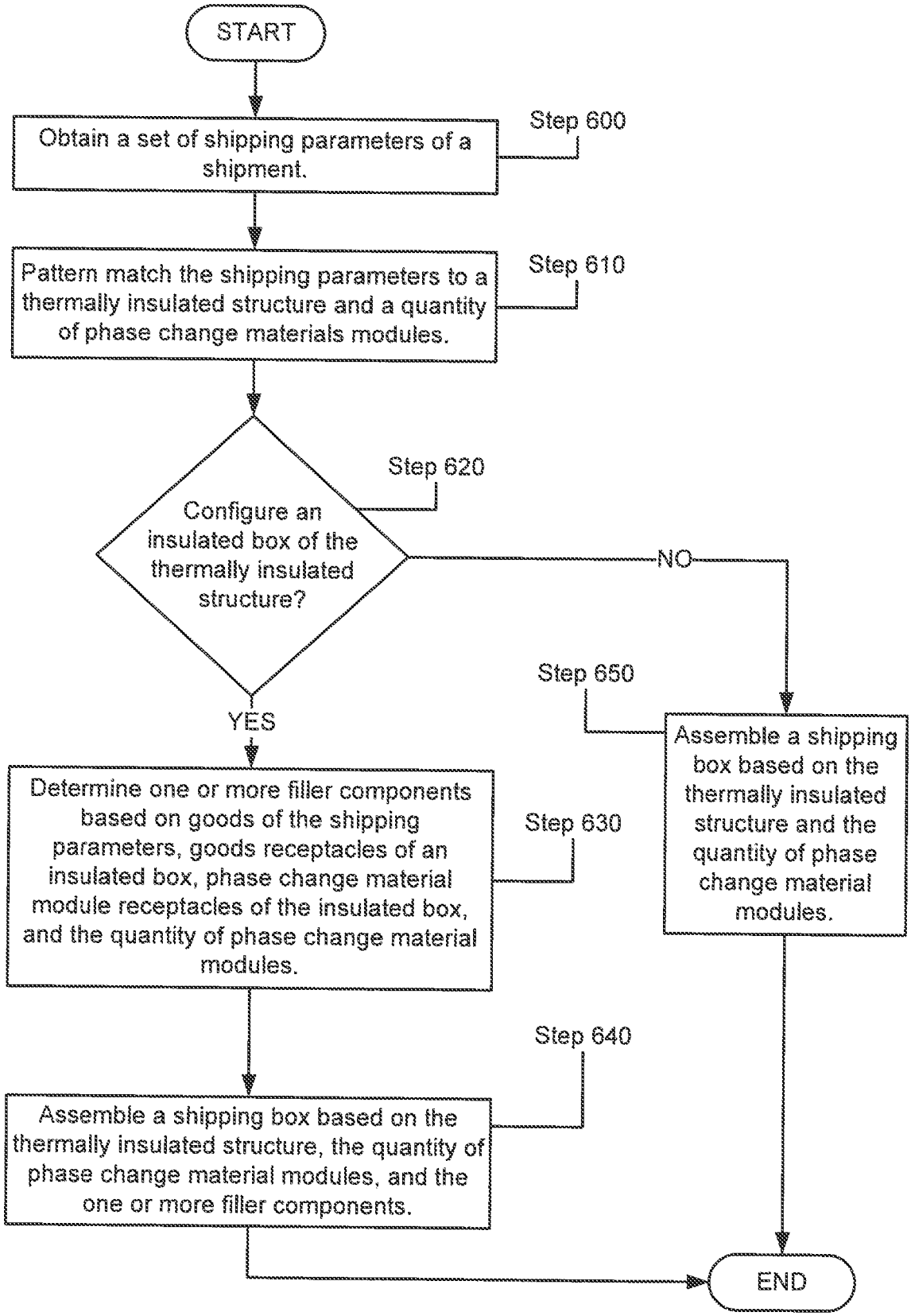
FIG. 6 shows a method of assembling a shipping box in accordance with one or more embodiments of the invention.

FIG. 6 shows a flowchart according to one or more embodiments of the invention. The method depicted in FIG. 6 may be used to assemble a shipping box in accordance with one or more embodiments of the invention. One or more steps shown in FIG. 6 may be omitted, repeated, and/or performed in a different order among different embodiments.

In Step 600, a set of shipping parameters of a shipment are obtained. The shipping parameters may be obtained by receiving the shipment parameters from a user or a customer that desires to ship goods. For example, a user or customer may send an order including the shipping parameters.

In one or more embodiments of the invention, only a portion of the shipment parameters may be received from a user or a customer. The remainder of the shipping parameters may be determined from a database including heuristically determined shipping parameters, e.g., a database that includes shipping parameters that have been previously determined by shipments.

In Step 610, the set of shipping parameters are pattern matched to a thermally insulated structure and a quantity of phase change material modules. As noted above, there may be a number of a number of thermally insulated structures having different components. Each of the thermally insulated structures may be associated with a range of shipping parameters. Based on the shipping parameters, a thermally insulated structure with specific components may be matched.

The specific components may include an insulated box including a number of phase change material module receptacles. Depending on the shipping parameters, a number of phase change material modules corresponding to the number of phase change material module receptacles or a number of phase change material modules that is less than the number of phase change material module receptacles may be used during a shipment. The shipping parameters may be matched to a number of phase change material modules and thereby determine a number of phase change material modules. In other words, there may not be a one to one correspondence of phase change material modules to phase change material module receptacles.

For example, a thermally insulated structure including an insulated box including four phase change material module receptacles may be pattern matched to the shipping parameters. The number of phase change material modules necessary to meet one or more of the shipping parameters may be less than the number of phase change material module receptacles. The number of phase change material modules may be matched to the shipping parameters based on the shipping parameters and the insulated box.

In Step 620, it is determined whether an insulated box of the thermally insulated structure mattered matched in Step 610 is to be configured. The insulated box may need to be configured if the insulated box includes a quantity of goods receptacles that is different than the quantity of goods included in the shipping parameters or the number of phase change material modules matched in Step 610 is different than the number of phase change material module receptacles of the insulated box. If the insulated box is to be configured, the methods may proceed to Step 630. If the insulated box does not need to be configured, the method may proceed to Step 650.

In Step 630, one or more filler components are determined. The filler components may be determined based on the goods of the shipping parameters, the type and quantity of goods receptacles of the insulated box, the quantity of phase change material modules, and the quantity of phase change material module receptacles. The filler components may be thermal insulation components having shapes corresponding to a goods receptacle or a phase change material module receptacle of the insulated box.

To determine the one or more filler components, any number of goods receptacles not have a corresponding good of the goods of the shipping parameters may be determined and any number of phase change material module receptacles not having corresponding phase change material modules may be determined. A filler component associated with each of the determined receptacles not having corresponding goods or phase change material modules may be determined.

In Step 640, a shipping box is assembled based on the pattern matched thermally insulated structure determined in Step 620, the pattern matched quantity of phase change material modules determined in Step 630, and the one or more filler components determined in Step 640. Assembling the shipping box may include obtaining the thermally insulated structure, inserting the quantity of phase change material modules into the insulated box of the thermally insulated structure or otherwise including the quantity of phase change material modules with the thermally insulated structure, and inserting one or more filler components into one or more goods receptacles and/or phase change material module receptacles of the insulated box of the thermally insulated structure or otherwise including the one or more filler components.

Returning to Step 620, if the insulated box does not need to be configured, the method may proceed to Step 650. In Step 650, a shipping box is assembled based on the pattern matched thermally insulated structure determined in Step 620 and the pattern matched quantity of phase change material modules determined in Step 630. Assembling the shipping box may include obtaining the thermally insulated structure and inserting the quantity of phase change material modules into the insulated box of the thermally insulated structure or otherwise including the quantity of phase change material modules with the thermally insulated structure.

Thus, the method shown in FIG. 6 may be used, for example, to assemble a shipping box include a thermally insulated structure based on a set of shipping parameters and thereby generate a shipping box that may meet the set of shipping parameters.

The following are examples of usages of a thermally insulated structures in accordance with one or more embodiments of the invention. In each of the following examples, a thermally insulated structure may include an insulated box and one or more phase change material modules. The insulated box and phase change material modules may vary in size, number, and shape in each example. The following examples are explanatory examples and not intended to the limit the invention.

Example 1

A user of a thermally insulated structure may desire to ship six bottles of wine. The user place each of the six bottles of wine in goods receptacles of an insulated box of the thermally insulated structure. The user may place phase change material modules in phase change material module receptacles of the insulated box.

The user may place a temperature data tracked to be disposed near and/or on the six bottles of wine. The user may close the insulated box, and place the insulated box within an outer shell of the thermally insulated structure surrounded by six vacuum panels of the thermally insulated box. The user may ship the thermally insulated structure including the six bottles of wine.

During the shipment, the temperature data tracker may transmit temperature measurements every 15 minutes to the user via a receiver. The receiver may be a cell phone of the user.

During the shipment, the temperature data tracker may send temperature measurements that indicates the wine did not exceed 80° F. during the shipment. Thereby, the user is notified that the wine was not damaged or otherwise spoiled during the shipment.

Example 2

A user of a thermally insulated structure may desire to ship six cans of beer, e.g., a six pack of beer. The user place each of the six cans of beer in goods receptacles of an insulated box of the thermally insulated structure. The user may place phase change material modules in phase change material module receptacles of the insulated box.

The user may place a temperature data tracked to be disposed near and/or on the six cans of beer. The user may close the insulated box, and place the insulated box within an outer shell of the thermally insulated structure surrounded by six vacuum panels of the thermally insulated box. The user may ship the thermally insulated structure including the cans of beer.

During the shipment, the temperature data tracker may transmit temperature measurements every 15 minutes to the user via a receiver. The receiver may be a cell phone of the user.

During the shipment, the temperature data tracker may send a temperature measurements that indicates the cans of beer did not exceed 70° F. during the shipment. Thereby, the user is notified that the beer was not damaged or otherwise spoiled during the shipment.

Example 3

A user of a thermally insulated structure may desire to ship four cartons of yogurt. The user place each of the four cartons of yogurt in goods receptacles of an insulated box of the thermally insulated structure. The user may place phase change material modules in phase change material module receptacles of the insulated box.

The user may place a temperature data tracked to be disposed and/or near the four cartons of yogurt. The user may close the insulated box, and place the insulated box within an outer shell of the thermally insulated structure surrounded by six vacuum panels of the thermally insulated box. The user may ship the thermally insulated structure including the four cartons of yogurt.

During the shipment, the temperature data tracker may store temperature measurements every 15 minutes to a memory of the temperature data tracker.

Upon receipt, a receiver of the shipment may connect to the temperature data tracker by a universal serial bus interface and receive the temperature measurements stored on the memory of the temperature data tracker. Thereby, the receiver is notified that the yogurt was not damaged or otherwise spoiled during the shipment.

Example 4

A customer of a shipper may desire to ship six bottles of wine. The customer may wish to ensure that the six bottles of wine do not exceed a temperature of 80° Fahrenheit. Based on the temperature that is to not be exceeded, the quantity of wine, a time of year, and/or a shipping route, the shipper may assemble a shipping box including a thermally insulated structure.

The thermally insulated structure may include phase change material modules. Each of the phase change material modules may include a quantity of phase change material having a solid-liquid phase change transition temperature of between 33-75° Fahrenheit depending on the heat profile of the shipping route.

The customer may add the bottles of wine to the thermally insulated structure and the shipper may ship the thermally insulated structure.

During shipment, the temperature of the environment surrounding the thermally insulated structure may be 90°. Heat may flow into the thermally insulated structure in response to the temperature of the surrounding environment. In response to the flow of heat, portions of the phase change material modules may undergo a solid-liquid phase transformation which prevents the flow of heat from the environment surrounding the thermally insulated structure from increasing the temperature or the bottles of wine above 80° Fahrenheit.

Example 5

A customer of a shipper may desire to ship four bottles of wine. The customer may wish to ensure that the four bottles of wine are not reduced below a minimum temperature of 45° Fahrenheit. Based on the temperature that is to not be reduced below, the quantity of wine, a time of year, and/or a shipping route, the shipper may assemble a shipping box including a thermally insulated structure.

The thermally insulated structure may include phase change material modules. Each of the phase change material modules may include a quantity of phase change material having a solid-liquid phase change transition temperature of between 40-55° Fahrenheit depending on the shipping route.

The customer may add the bottles of wine to the thermally insulated structure and the shipper may ship the thermally insulated structure.

During shipment, the temperature of the environment surrounding the thermally insulated structure may be 30° Fahrenheit. Heat may flow out of the thermally insulated structure in response to the temperature of the surrounding environment. In response to the flow of heat, portions of the phase change material modules may undergo a liquid-solid phase transformation which prevents the flow of heat from the thermally insulated structure from reducing the temperature or the bottles of wine below 45° Fahrenheit.

One or more embodiments of the invention may provide one or more of the following advantages: i) a thermally insulated structure in accordance with embodiments of the invention may regulate a temperature of a good for a longer period of time than by insulation alone, ii) a thermally insulated structure in accordance with embodiments of the invention may be configurable and thereby be employed for a broad range of goods, iii) a thermally insulated structure in accordance with embodiments of the invention may regulate a temperature of a good to a desired range for a desired period of time of, for example, seven days, iv) a thermally insulated structure in accordance with embodiments of the invention may weigh equal to or less than 7.5 pounds less the weight of the goods to be shipped, v) a thermally insulated structure in accordance with embodiments of the invention may notify a user if the goods exceeded a temperature during a shipment, and vi) a thermally insulated structure in accordance with embodiments of the invention may be reusable, e.g., no component of the thermally insulated structure is used up or otherwise lost during shipment.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A method of configuring one or more thermally insulated shipping containers for shipment of goods, comprising:

providing different types of phase change material modules, wherein each type of phase change material module has a respective set of thermal characteristics;

obtaining a first set of shipping parameters for a first shipment;

pattern matching the first set of shipping parameters for the first shipment to at least one of the different types of phase change material modules according to its respective set of thermal characteristics;

pattern matching the first set of shipping parameters for the first shipment to a first thermally insulated shipping container;

determining one or more filler components for the first thermally insulated shipping container based on, at least in part, a quantity of goods of the first set of shipping parameters; and configuring the first thermally insulated shipping container based on, at least in part, the pattern matching of the first set of shipping parameters to at least one of the different types of phase change material modules and the determined one or more filler components for the first thermally insulated shipping container.

2. The method of claim 1, wherein determining one or more filler components for the first thermally insulated shipping container is further based on, at least in part, a quantity of goods receptacles in the one or more filler components of the first thermally insulated shipping container.

3. The method of claim 2, wherein a quantity of goods of the first set of shipping parameters is different from the quantity of goods receptacles in the one or more filler components of the first thermally insulated shipping container.

4. The method of claim 1, wherein determining one or more filler components for the first thermally insulated shipping container is further based on, at least in part, a quantity of phase change material module receptacles of the first thermally insulated shipping container and a first quantity of phase change material modules.

5. The method of claim 4, wherein the first quantity of phase change material modules is different from the quantity of phase change material module receptacles of the first thermally insulated shipping container.

6. The method of claim 1, further comprising:

obtaining a second set of shipping parameters for a second shipment;

pattern matching the second set of shipping parameters for the second shipment to at least another one of the different types of phase change material modules according to its respective set of thermal characteristics;

pattern matching the second set of shipping parameters for the second shipment to a second thermally insulated shipping container;

determining one or more filler components for the second thermally insulated shipping container based on, at least in part, a quantity of goods of the second set of shipping parameters; and configuring the second thermally insulated shipping container based on, at least in part, the pattern matching of the second set of shipping parameters to at least another one of the different types of phase change material modules and the determined one or more filler components for the second thermally insulated shipping container.

7. The method of claim 6, wherein the quantity of goods for the second set of shipping parameters for the second shipment is different from the quantity of goods for the first set of shipping parameters for the first shipment.

8. The method of claim 6, wherein the determined one or more filler components for the second thermally insulated shipping container is different from the determined one or more filler components for the first thermally insulated shipping container.

9. The method of claim 1, wherein each of the different types of phase change material modules comprises a respective phase change material.

10. The method of claim 9, wherein each respective phase change material is a mixture of water and salt.

11. The method of claim 9, wherein the thermal characteristics comprise a respective solid-liquid phase temperature for each phase change material.

12. The method of claim 11, wherein the respective solid-liquid phase temperature for each phase change material relates to a desired temperature profile.

13. The method of claim 12, wherein the desired temperature profile comprises a maximum temperature for shipment.

14. The method of claim 12, wherein the desired temperature profile comprises a minimum temperature for shipment.

15. The method of claim 10, wherein the respective thermal characteristics of the different types of phase change material modules is set by the mixture of water and salt in the respective phase change material.

16. The method of claim 1, wherein the first thermally insulated shipping container comprises:

an insulated box; and a set of vacuum panels configured to form an encapsulating layer around the insulated box.

17. The method of claim 16, wherein each vacuum panel of the set of vacuum panels comprises:

a core comprising an insulating material;

an inner layer that encapsulates the core comprising a vapor barrier material; and an outer layer that encapsulates the inner layer comprising a radiant barrier material.

18. A method of configuring one or more thermally insulated shipping containers for shipment of goods, comprising:

providing different types of phase change material modules, wherein each type of phase change material module comprises a respective phase change material and has a respective set of thermal characteristics, wherein each of the respective sets of thermal characteristics comprise a respective solid-liquid phase temperature for the respective phase change material;

obtaining a first set of shipping parameters for a first shipment;

pattern matching the first set of shipping parameters for the first shipment to at least one of the different types of phase change material modules according to its respective set of thermal characteristics;

pattern matching the first set of shipping parameters for the first shipment to a first thermally insulated shipping container;

determining one or more filler components for the first thermally insulated shipping container based on, at least in part, a quantity of goods of the first set of shipping parameters; and configuring the first thermally insulated shipping container based on, at least in part, the pattern matching of the first set of shipping parameters to at least one of the different types of phase change material modules and the determined one or more filler components for the first thermally insulated shipping container.

19. The method of claim 18, wherein each respective phase change material is a mixture of water and salt.

20. The method of claim 18, wherein the respective sets of thermal characteristics each comprise a respective solid-liquid phase temperature for the respective phase change material.

21. The method of claim 20, wherein the respective solid-liquid phase temperature for each phase change material relates to a desired temperature profile.

22. The method of claim 21, wherein the desired temperature profile comprises a maximum temperature for shipment.

23. The method of claim 21, wherein the desired temperature profile comprises a minimum temperature for shipment.

24. The method of claim 19, wherein the respective thermal characteristics of the different types of phase change material modules is set by the mixture of water and salt in the respective phase change material.

* * * * *